US007621152B2

(12) United States Patent
Howard

(10) Patent No.: US 7,621,152 B2
(45) Date of Patent: Nov. 24, 2009

(54) COMPACT CRYOGENIC PLANT

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 319 days.

(21) Appl. No.: 11/360,513

(22) Filed: Feb. 24, 2006

(65) Prior Publication Data

US 2007/0199344 A1 Aug. 30, 2007

(51) Int. Cl.
*F25J 3/00* (2006.01)

(52) U.S. Cl. ..... 62/620; 62/643; 62/907; 62/911

(58) Field of Classification Search ..... 62/901, 62/907, 911, 643, 920
See application file for complete search history.

(56) References Cited

U.S. PATENT DOCUMENTS 2,908,121 A * 10/1959 Enos, Jr. ..... 53/399
4,017,284 A * 4/1977 Gifford ..... 62/643
5,349,827 A * 9/1994 Bracque et al. ..... 62/298
5,617,742 A * 4/1997 Toppel ..... 62/643
6,101,840 A * 8/2000 Watanabe et al. ..... 62/643
6,128,921 A * 10/2000 Guillard et al. ..... 62/643
6,134,915 A * 10/2000 Denzau et al. ..... 62/643
6,148,637 A * 11/2000 Guillard et al. ..... 62/643
6,205,815 B1 3/2001 Bruder et al. ..... 62/643
6,272,883 B2 8/2001 Bruder et al. ..... 62/643
6,948,337 B2 * 9/2005 Moeller et al. ..... 62/643
6,957,551 B2 10/2005 Moeller et al. ..... 62/643
2006/0260357 A1 * 11/2006 Gibbon ..... 62/643

* cited by examiner

*Primary Examiner*—William C Doerrler
(74) *Attorney, Agent, or Firm*—David M. Rosenblum

(57) ABSTRACT

A cryogenic plant having at least two direct phase separation devices such as distillation columns whose circular perimeters serve to define the perimeter of the cold box encompassing the direct phase separation devices and ancillary equipment for the process.

12 Claims, 3 Drawing Sheets

COMPACT CRYOGENIC PLANT

TECHNICAL ART

This invention relates generally to apparatus for carrying out a cryogenic process, and is particularly useful for processes involving cryogenic air separation.

BACKGROUND ART

Cryogenic plants such as those found in natural gas processing and air separation are characterized by the use of a cold box. A cold box is an insulated enclosure which encompasses sets of process equipment such as heat exchangers, columns and phase separators. Such sets of process equipment may form the whole or part of a given process.

Chemical separation and liquefaction processes which occur at sub-ambient temperature are characterized by the need to mitigate ambient heat ingress. In addition, such processes are also characterized by the need to minimize lost work both in form of heat and mass transfer irreversibility. As a consequence, sub-ambient heat and mass transfer operations are often characterized by large distillation columns and by high area density heat exchange equipment. Given the size of the process equipment, the mitigation of heat ingress into this equipment is essential in order to minimize the need for additional refrigeration and associated power consumption.

The fabrication and shipment of process equipment packaged in a cold box may be constrained by numerous factors. In most instances, issues associated with transportation limit cold box specifications in terms of weight, length and cross section area and associated dimensions. The maximization of production capacity from a given cold box size/cross section would be very desirable.

SUMMARY OF THE INVENTION

One aspect of the invention is:

Apparatus for carrying out a cryogenic process comprising:

(A) two direct phase separation devices, each direct phase separation device having a circular perimeter;

(B) a cold box perimeter enclosing the said direct phase separation devices, each direct phase separation device perimeter bordering the cold box perimeter at at least one point; and (C) at least one piece of ancillary equipment within the cold box perimeter.

Another aspect of the invention is:

A method for designing an apparatus for carrying out a cryogenic process comprising specifying two direct phase separation devices, each of which has a circular perimeter; specifying a cold box perimeter which encloses the said direct phase separation devices and wherein each direct separation device perimeter borders the cold box perimeter at at least one point; and providing for at least one piece of ancillary equipment within the cold box perimeter.

As used herein the term "direct phase separation device" means any unit operation which serves to separate a combined gas and liquid stream. Such a device may be a column which serves to separate multiple liquid and vapor streams or more simply a phase separator or flash drum in which a single two-phase stream is separated into its respective gas and liquid component streams.

As used herein the term "ancillary equipment" means equipment which is employed to carry out a cryogenic process and is not a direct phase separation device. Primarily these are the associated heat exchangers (primary and latent heat exchangers). However, it can include the major process conduit and minor supporting phase separators. For instance, often liquid streams are stored in surge volumes, not necessarily a phase separation. Alternatively, phase separators are used for purposes of facilitating heat exchange with a brazed aluminum heat exchanger, it is often necessary to separate the phases of a two phase stream prior to feeding it into the core, even though the streams are subsequently recombined.

As used herein the term "bordering" means actually in contact with or proximate to the inner wall of the insulated enclosure which forms the perimeter of the cold box.

Figure 1:
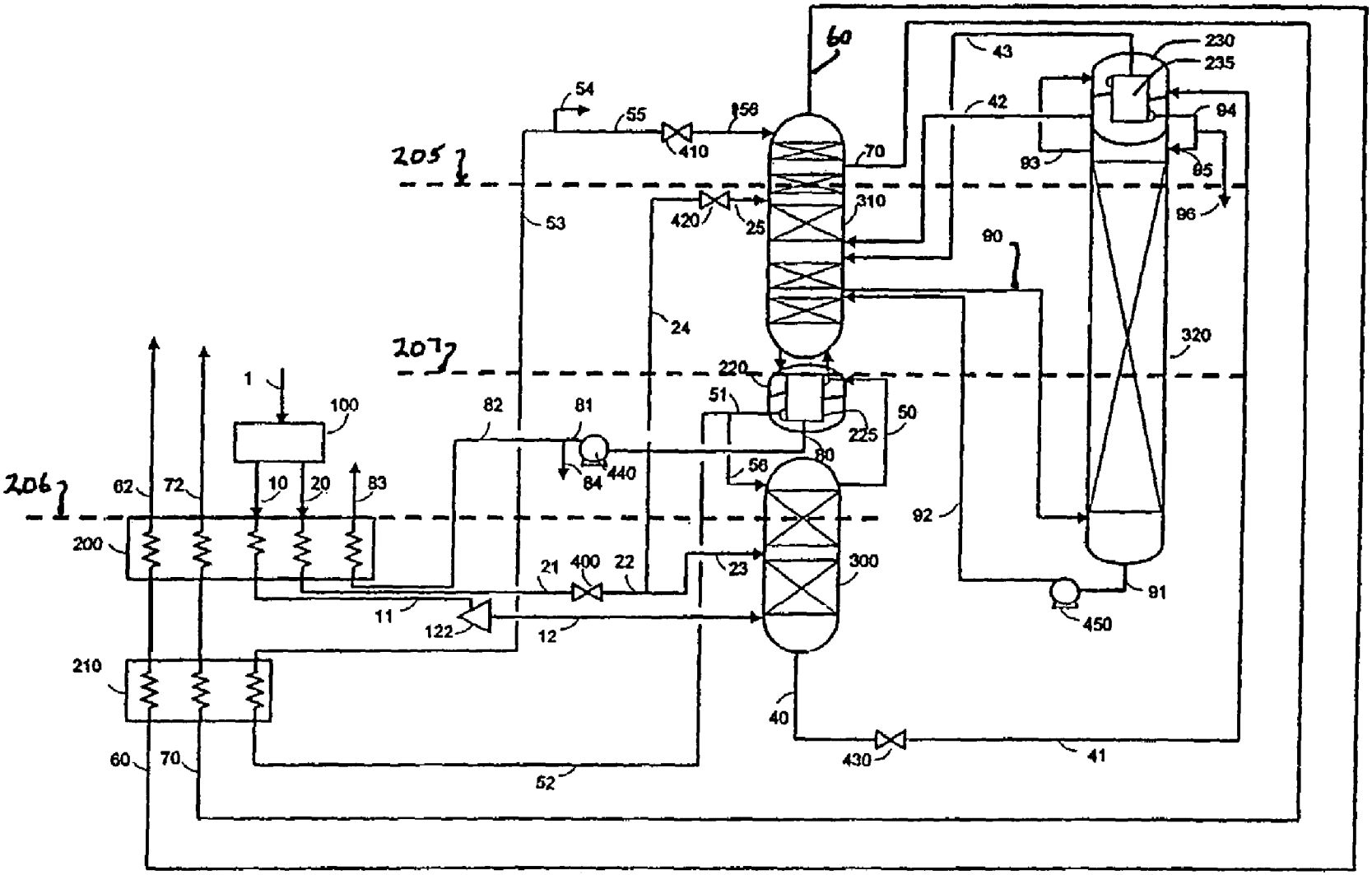
FIG. 1 is a schematic representation of one embodiment of a cryogenic air separation plant which can benefit by the use of this invention.

Each of FIGS. 2, 3, 4 and 5 depict a horizontal cross sectional view of the cryogenic air separation plant shown in FIG. 1.

The numerals in the Drawings are the same for the common elements.

DETAILED DESCRIPTION

In the practice of this invention an insulating container or cold box is designed to encompass the circular perimeters of at least two direct phase separation devices with minimal additional insulating margin. This cold box perimeter creates a defining perimeter. The defining perimeter dimensions are selected in order to minimize cold box volume and/or construction cost. More particularly, the specification of all associated heat exchange and other associated phase separation equipment is thereby constrained to fit within the defining cold box perimeter. While the cold box perimeter may be any shape, typically the cold box perimeter has a rectilinear or circular shape.

The invention may be practiced in conjunction with any cryogenic process such as a cryogenic air separation process or a light hydrocarbon separation process. A particularly advantageous embodiment is found in cryogenic air separation processes employing at least two distillation columns wherein at least two of these columns reside within the same cold box side by side (i.e. where they traverse the same cold box cross section). In this configuration, both the latent and sensible heat exchangers contained within the cold box are designed to a specification which constrains the respective block sizes or perimeters of the heat exchangers (or combinations of block sizes) so as to be less than or equal to at least one dimension as specified by the defining perimeter. In a further preferred embodiment, no combination of heat exchanger and/or column section(s) anywhere within the same cold box is designed with a combined dimension that exceeds any one dimension as specified by the defining perimeter. Preferably at least one dimension of such heat exchanger borders the cold box perimeter.

An important technical advantage of the present invention relative to conventional practice is found in the fact that cold box throughput is maximized for a given cross section. Conventional systems have been primarily focused upon the manufacturing approach and process modularization. The subject invention details a method of equipment sizing so that cold box constraints are satisfied. In so doing, the value of subsequent modularization is maximized because the components have been designed with the original intent of maximizing throughput. The invention enables the design of modules (sets of exchangers and columns) that represent a maximum capacity. Groupings of such sets would also result in plants of high throughput with respect to a fixed cold box cross section.

The invention will be described in greater detail with reference to the Drawings. Referring now to FIG. 1, a feed air stream 1 is first directed to compression and pretreatment means 100. Operation 100 may encompass numerous stages of intercooled air compression as well as dehydration and purification for the removal of high boiling contaminants. Operation 100 may also encompass additional stages of dry-booster air compressor for purposes of generating clean dry pressurized air streams 10 and 20 which may not necessarily be at the same pressure. A first portion of the air stream 10 is cooled by partial traversal of primary heat exchanger (PHX) 200 and exits as stream 11 at a temperature within the range of 125 to 190 K. Stream 11 is then expanded in turboexpander 122. The turbine exhaust 12 is then directed to base of column 300 as primary gaseous air feed. A second portion of the air stream 20 is cooled and condensed in PHX 200 and exits as stream 21 in a substantially condensed and subcooled state. This stream may then be pressure reduced via valve 400 and directed to the column system by way of stream 22 which may be split and sent to the higher pressure column 300 by way of stream 23 or to lower pressure column 310 by way of stream 24 through valve 420 and then into the column as stream 25.

Columns 300, 310 and 320 represent distillation columns in which vapor and liquid are countercurrently contacted in order to affect a gas/liquid mass-transfer based separation of the respective feed streams. Columns 300, 310 and 320 will preferably employ packing (structured or random) or trays or combinations thereof.

Air streams 23 and 12 are directed to moderate pressure column 300. Column 300 serves to separate the respective streams into a nitrogen rich overhead and oxygen enriched bottoms stream. The condensation of the overhead gas 50 is effected by main condenser 220. The main condenser in this depiction is shown as a separate shell 220 in which a condenser/reboiler 225 resides. It is possible for this structure to be integrated with either column 300 or 310. The latent heat of condensation is thereby imparted to the oxygen rich bottoms fluid of column 310. The resulting nitrogen rich liquid stream 51 is then used as a reflux liquid for both the moderate pressure column in stream 56 and for the lower pressure column 310 in stream 156. An oxygen enriched liquid 40 is also withdrawn from column 300 and is then directed through pressure reduction valve 430 prior to entry into overhead argon condenser 230 associated with column 320 as stream. 41. The resulting vapor 43 and liquid 42 streams obtained from condenser 230 are then directed as feeds to lower pressure column 310.

Column 310 operates at a pressure within the range of 1.1 to 1.5 bara. Nitrogen rich liquid 52 is first subcooled in exchanger 210 and exits as stream 53 which may be split into a product liquid stream 54 and the reflux liquid stream 55. Stream 55 is reduced in pressure via valve 410 and is introduced into column 310 as stream 156. Within column 310 streams 156, 27, 43 and 42 are further separated into nitrogen rich overhead streams 60 and 70 and into an oxygen rich bottoms liquid 80. Nitrogen rich streams 60 and 70 are warmed to ambient by indirect heat exchange within exchangers 210 and 200 consecutively, subsequently emerging as warmed lower pressure nitrogen streams 62 and 72 respectively. It should be noted that stream 62 may be taken as a co-product nitrogen stream and compressed as necessary. Stream 72 may be used as a purge/sweep fluid for purposes of regenerating adsorbent systems which may form part of operation 100.

Column 320 represents an argon recovery column which operates at a pressure comparable to column 310. The gaseous argon containing feed 90 is extracted from a lower interstage section of column 310 and is directed to the base of column 320. Column 320 serves to rectify feed 90 into a nearly pure argon rich overhead stream 93 which is condensed within latent exchanger 230. The resulting liquid argon stream 94 is taken from the condenser and split into a column reflux stream 95 and a product liquid stream 96 which may be sent to storage or further processing as required. From the base of column 320 an argon depleted oxygen rich stream is extracted as stream 91. This stream is pressurized by mechanical pump 450 and directed back to column 310 as stream 92. This operation is necessary since many times the height required for argon rectification greatly exceeds the available height of the low pressure nitrogen rectification sections of column 310.

An oxygen rich liquid 80 is extracted from the base of lower pressure column 310. This stream is then compressed by a combination of gravitational head and by mechanical pump 440. Pumped oxygen stream 81 may then be split into a product liquid stream 84 (and directed to storage not shown) and stream 82. Stream 82 undergoes vaporization and warming within PHX 200 and emerges as high pressure gaseous stream 83 typically at a pressure within the range of 10 to 50 bar.

With respect to FIG. 1 two horizontal cross sections have been indicated. By thermodynamic simulation, the combined vapor flow transiting columns 310 and 320 results in the largest volumetric gas rate proceeding through any one cross section of the above described column system. As such the column section/diameters below the waste/impure nitrogen draw stream 70 coincides with a point of nearest approach for columns 310 and 320. In accordance with the invention, the defining perimeter cold box cross sectional size is specified from these columns at this nearest point of approach.

Figure 3:
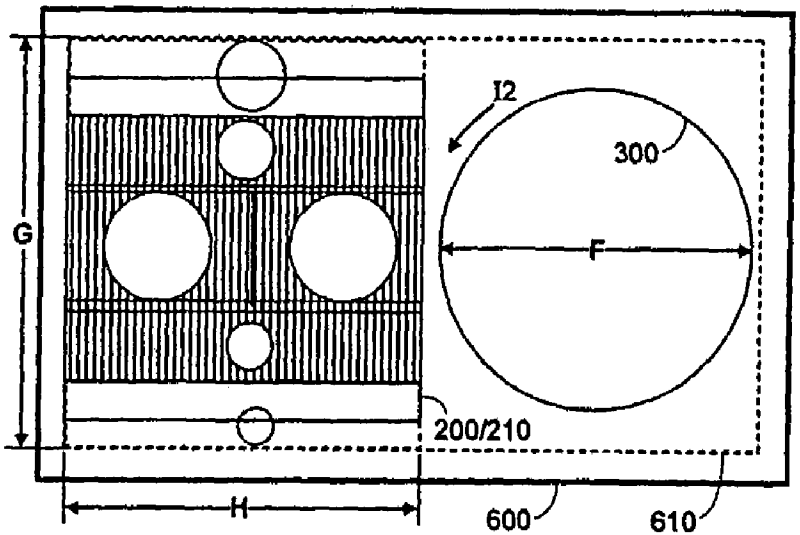
Figure 2:
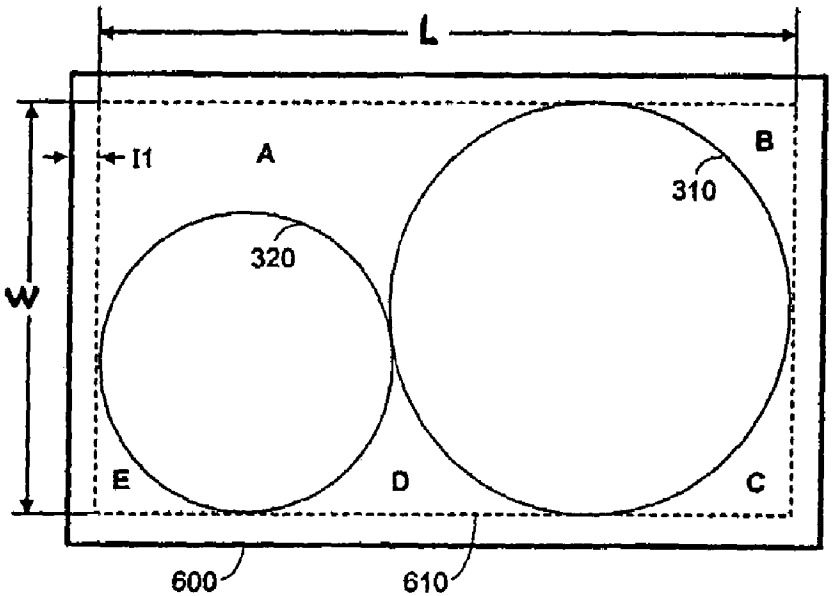
Figure 4:
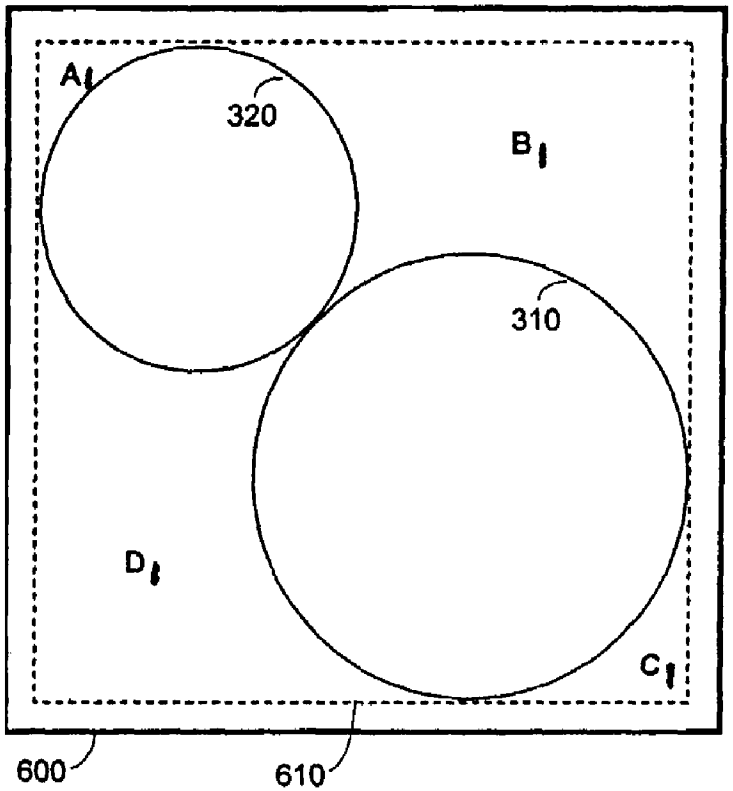
Figure 5:
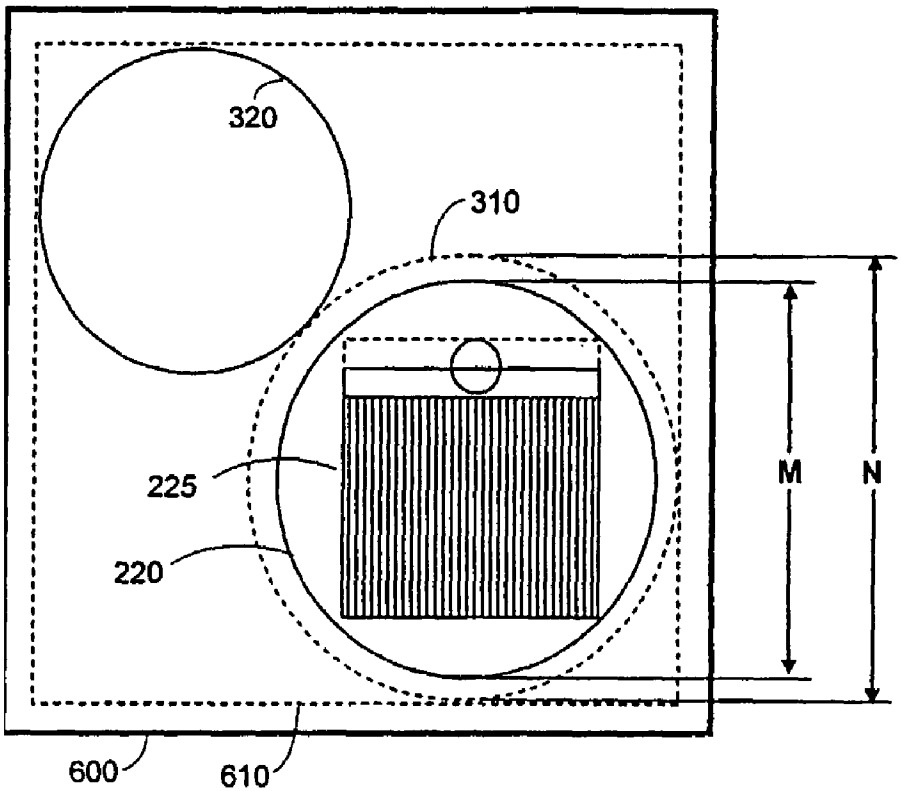

FIGS. 2-5 represent horizontal cross sectional views of the cold box process describe in FIG. 1, dashed line 205 for FIGS. 2 and 4, dashed line 206 for FIG. 3 and dashed line 207 for FIG. 5. The locations of these cross sections are denoted on FIG. 1. For the sake of clarity, the column/vessel perimeters have been depicted without internals (packing/distributors) and the stream conduits have been omitted.

In reference to FIGS. 2 and 3, the exterior perimeter of the cold box is indicated by 600. Typically there exists 9" to 18" of insulating margin (I1) in order to mitigate cold box heat ingress and to allow for structural/framework support of the cold box. This interior perimeter 610 of the cold box is the defining perimeter as described with respect to columns 310 and 320. In this case, the perimeter is a rectilinear perimeter defined by Width (W) and Length (L). Perimeter 610 dimensions (W) and (L) encompass the respective columns 310 and 320. Primary low pressure column 310 and argon column 320 are positioned so that they are both tangent to and are bordering the same side of the cold box perimeter. Stream conduits (55, 60, 70, 41, 42, 43 and 96) can be shown to fit within vacant regions labeled A, B, C, D and E.

FIG. 3 illustrates another/lower cross section of FIG. 1. The essential aspects of the invention are illustrated with respect to this Figure. In particular, the perimeter 610 is also shown in this Figure (it has been translated downward from the cross section of FIG. 2. This perimeter now creates a defining constraint for subsequent heat exchanger and column sizing at a lower location in the cold box.

The use of brazed aluminum heat exchangers (BAHX) for cryogenic service is well established. The multi-pass ability, high heat transfer rates and high area density has resulted in BAHX technology becoming an industry standard. Through appropriate selection of BAHX fins (width, dimension, spacing and type) the aspect ratio of a modern BAHX can be manipulated over a broad range (i.e. the same heat exchange service can be accommodated by numerous BAHX block sizes). Similarly, column diameter can be manipulated through a judicious selection of trays or a number of structured column packing types/densities. Similar procedures are known to the art of air separation for purposes of sizing latent heat exchangers like those depicted by items 220 and 230 within FIG. 1.

Near the base of a cold box incorporating multiple unit operations such as those shown in FIG. 1 will most likely reside at least the primary heat exchanger and perhaps the lower column 300. In reference to FIG. 3, PHX 200 is depicted. Heat exchanger 210 can be integrated with 200 as necessary (it is referenced as exchanger 200/210 in FIG. 3). In this arrangement, the sizing of exchanger 200 takes into account a dimension (W) defined by perimeter 610 from FIG. 2. In the case of FIG. 3, the stack width (plus headering and nozzles) dimension (G) is specified so that the perimeter of exchanger 200/210 does not exceed perimeter 610 Width (W). In a preferred design approach, dimension (G) will be nearly equal to Width (W). In effect the specification of the major columns (310, 320) creates a dimensional constraint on exchanger 200/210. It should be noted that the BAHX dimension (G) is the sum of the stack width plus all of the associated headering and nozzles.

FIG. 3 also depicts a representative diameter and location for higher pressure column 300 (lower column). The diameter of column 300 will preferably be specified so that the sum of the column 300 diameter (F) the BAHX 200 stack height (H) and any insulating margin between the two (I2) does not exceed interior perimeter 610 Length (L).

FIG. 4 depicts an alternative cross sectional design at a location comparable to that shown in FIG. 2. In contrast, FIG. 4 depicts columns 310 and 320 positioned diagonally so that tangents are struck with and the columns border opposite sides of the interior cold box perimeter 610. The associated conduit can be positioned at the discretion of the designer within vacant regions $A_1$, $B_1$, $C_1$, and $D_1$.

FIG. 5 depicts a lower cross section of the same box wherein the cross section under consideration bisects both the main condenser (220/225) and the argon column 320. The positioning of low pressure column 310 is shown as a dotted line (it does not transit this section of the cold box). Its diameter is denoted by dimension (N). The main condenser 220/225 associated with high and low pressure columns of FIG. 1 may be affected by any number of potential designs. The option depicted is an option based upon an open ended BAHX core 225 operated in a thermosyphon mode. The enclosing vessel/perimeter 220 encompasses exchanger 225 and has diameter of (M). The perimeter of main condenser 220 does not exceed the perimeter created by columns 310 and 320 as shown in FIG. 4. In a preferred embodiment, the diameter (M) of 220 equals the diameter (N) of column 310.

By designing the cold box so that only the major column/distillation operations set the perimeter of the cold box a maximum in plant capacity is obtained. In general, there is substantially more latitude available in the design of the latent and sensible heat exchangers than there is with respect to column design. Furthermore, the aspect ratio (Height:Width) of the major columns often greatly exceeds the aspect ratio of the major exchangers. For instance, the low pressure column 310 may exhibit an aspect ratio of 15 to 20 whereas the corresponding main condenser may exhibit an aspect ratio of only 2 to 4. As a consequence, an optimal packaging of the major columns with respect to the horizontal cross section is far more important than adapting the cold box to the major exchangers. As a consequence of the above described approach, a cold box of very high capacity is achieved with a concomitant savings in fabrication costs.

There exist numerous modifications to the basic column system shown in FIG. 1. It is known that the two-pressure thermally linked double column can be used to recover both high and low purity oxygen. It is conceivable that the two column approach defining cold box perimeter could be applied to a parallel positioning of column 300 and 310. Other two column low purity processes and nitrogen plants may also be amenable to the subject approach. In addition, it is also known that columns can be split into multiple sections. The subject design approach can be used when even sections of the same column transit the same section of a common cold box.

The defining perimeter of the cold box need not be rectilinear. Other geometries which may be use in cold box design include circular, triangular, pentagonal and hexagonal structures.

It is known to equip lower pressure columns (e.g. 310 and 320) with stiffening rings. Such rings are essentially horizontal extensions of the column shell which serve to enhance structural integrity (and maintain symmetry). The column perimeters shown in FIGS. 2-5 should take into account the additional perimeter defined by such rings.

The argon column can be split for purposes of creating more compact cold boxes. In this instance perimeter 320 will encompass two shells. It is likely both shells will transit the same space as the column 310 as such the defining perimeter is formed by the inclusion of three columns instead of the two shown in FIGS. 2-5.

Any number of main condenser 220 exchanger types could be used within the invention. These options include enhanced surface tubular exchangers or closed ended BAHX thermosyphon designs. Alternatively, the exchanger designs may be configured for once through boiling or may utilize elements of down flow evaporation. Use of such options is consistent with the overriding objective of the current invention.

Although FIG. 3 illustrates that two major operations may reside within a defining cold box perimeter (610) it is conceivable that three or more unit operations could be sized to fit within at least one dimension defined by perimeter 610. In some instances, the pinch point (point of closest approach) may be created by another phase separation device other than two distillation columns. The separation perimeters may in fact incorporate any combination of simple phase disengagement vessels, dephlegmator or reflux type heat exchangers (combined heat and mass transfer operations).

Prospective process technologies which benefit from this invention also include a broad array of cryogenic natural gas processes (examples include nitrogen rejection and $C_2$+ removal processes and He-rare gas extraction). Other cryogenic separations including synthesis gas separation (Cl/CO/$H_2$) may also prove relevant. Other cryogenic separations including ethylene/propylene extraction from cracked gas mixtures may also benefit from the present invention.

Larger air separation processes may preferably segregate the PHX cores from the column system. The invention is still amenable to the definition of the latent exchanger (e.g. 220 and 230). Again the objective being that the cold box perimeter defined by the columns constrains the size of the associated heat exchangers within a common cold box. Moreover, it is possible to configure BAHX cores beneath a column system. In such systems multiple dimensions derived form the defining perimeter may constrain or limit the size of the associated BAHX core.

In other preferred embodiments of the invention more than two direct phase separation devices may border the cold box perimeter. The perimeter of a direct phase separation device may define one dimension of the cold box perimeter. At least one dimension of the ancillary equipment is equivalent to at least one dimension of the cold box perimeter. More than one piece of ancillary equipment may be employed having combined dimensions which are equivalent to at least one dimension of the cold box perimeter. The ancillary equipment may be a phase separation device or conduit.

Although the invention has been described in detail with reference to certain preferred embodiments, those skilled in the art will recognize that there are other embodiments of the invention within the spirit and the scope of the claims.

The invention claimed is:

1. Apparatus for carrying out a cryogenic process comprising:

(A) two direct phase separation devices, each direct phase separation device having a circular perimeter and being positioned such that the two direct phase separation devices contact one another at the circular perimeter of each of the two direct phase separation devices;

(B) a cold box enclosing the said two direct phase separation devices and having four opposed sidewalls of elongated configuration and insulation covering interior surfaces of the four opposed sidewalls to define a cold box perimeter, the circular perimeter of one of the two direct phase separation devices bordering the cold box perimeter at least at two points situated at one of two pairs of adjacent sidewalls and the circular perimeter of the other of the two direct phase separation devices bordering the cold box perimeter solely at two points situated at the other of the two pairs of adjacent sidewalls located opposite to the one of the two pairs of adjacent sidewalls; and (C) at least one piece of ancillary equipment positioned within the cold box perimeter beneath one of the two direct phase separation devices.

2. The apparatus of claim 1 wherein at least one dimension of said ancillary equipment borders the cold box perimeter.

3. The apparatus of claim 2 wherein at least one dimension of said ancillary equipment is equivalent to at least one dimension of the cold box perimeter.

4. The apparatus of claim 1 further comprising at least one other direct phase separation device within the cold box perimeter.

5. The apparatus of claim 1 wherein the direct phase separation devices are distillation columns.

6. The apparatus of claim 1 wherein the ancillary equipment is a heat exchanger.

7. The apparatus of claim 1 wherein the ancillary equipment is another phase separation device.

8. The apparatus of claim 1 wherein all the ancillary equipment required for the process is within the cold box perimeter.

9. The apparatus of claim 1 wherein cryogenic process is a cryogenic air separation process.

10. The apparatus of claim 1 wherein the cryogenic process is a light hydrocarbon separation process.

11. The apparatus of claim 1 wherein more than two direct phase separation devices border the cold box perimeter.

12. The apparatus of claim 1 comprising at least two pieces of ancillary equipments having combined dimensions which are equivalent to at least one dimension of the cold box perimeter.

* * * * *